US005145173A

United States Patent [19]

Crowder

[11] Patent Number: 5,145,173

[45] Date of Patent: Sep. 8, 1992

[54] BASEBALL GAME

[75] Inventor: Michael A. Crowder, Flint, Mich.

[73] Assignee: The Pent Corporation, Flint, Mich.

[21] Appl. No.: 684,856

[22] Filed: Apr. 15, 1991

[51] Int. Cl.[5] ..... A63F 1/04

[52] U.S. Cl. ..... 273/93 C; 273/298

[58] Field of Search ..... 273/93 R, 93 C, 244, 273/247, 298, 88, 277

[56] References Cited

U.S. PATENT DOCUMENTS

| | | | |
|---|---|---|---|
| 1,177,677 | 4/1916 | Beam | 273/298 |
| 1,230,317 | 6/1917 | Norpoth | 273/298 |
| 1,259,987 | 3/1918 | Huff et al. | 273/93 C |
| 1,530,316 | 3/1925 | Hammons | 273/298 |
| 1,557,284 | 10/1925 | Horowitz | 273/93 C |
| 1,684,189 | 9/1928 | Meyer | 273/93 C |
| 2,347,506 | 4/1944 | Riehle | 273/93 R |
| 2,788,213 | 4/1957 | Hull | 273/298 X |
| 2,812,181 | 11/1957 | Richman | 273/298 X |
| 2,886,319 | 5/1959 | Henderson | 273/244 X |
| 3,528,661 | 9/1970 | Warner | 273/93 C |
| 3,957,269 | 5/1976 | Bouchard | 273/93 C |
| 4,000,897 | 1/1977 | York | 273/93 C |
| 4,010,957 | 3/1977 | Tricoli . | |
| 4,169,600 | 10/1979 | Rakowski | 273/247 |
| 4,210,335 | 7/1980 | Licciardi | 273/238 |
| 4,261,569 | 4/1981 | Frohlich | 273/93 C |
| 4,327,914 | 5/1982 | Dowell | 273/93 C |
| 4,653,755 | 3/1987 | Panella et al. | 273/93 R |
| 4,687,199 | 8/1987 | Aguirregomezcorta | 273/93 R |
| 4,776,593 | 10/1988 | DiPersio et al. | 273/93 C |
| 4,822,043 | 4/1989 | Carter | 273/93 C |

*Primary Examiner*—Theatrice Brown
*Assistant Examiner*—Sebastiano Passaniti
*Attorney, Agent, or Firm*—Gifford, Groh, Sprinkle, Patmore and Anderson

[57] ABSTRACT

A baseball game played with baseball type player trading cards requiring only the baseball cards, a die and a deck of standard playing cards. The player cards have a specific player's picture and statisitcs on one side and a matrix incorporating his statistics on the reverse side. The cards are divided into teams, each with a pitcher. The die is tossed to determine which matrix (player or pitcher) is used and a standard playing card is selected to determine which cell in the matrix creates the play. The game is played easily and quickly. The cards can be purchased individually by desired player or in former or current teams.

7 Claims, 2 Drawing Sheets

30

Jones, John
1st Base
New York Yankees

| | Heart | Club | Diamond | Spade |
|---|---|---|---|---|
| A | GO | GO | FO A1 | HR |
| 2 | FO | GO | GO | GO |
| 3 | GO | Walk | 1-A2 | GO-DP |
| 4 | GO | HR | FO | FO |
| 5 | Walk | 1-A1 | SO | FOA-1 |
| 6 | FO | GO | Walk | SO |
| 7 | FO | FO-A1 | FO-A1 | 1-A2 |
| 8 | FO | GO | GO | GO |
| 9 | 1-A2 | 1-A2 | GO | FO-A1 |
| 10 | 1-A2 | 1-A2 | FO | 1-A1 |
| J | FO | 1-A1 | GO | GO |
| Q | FO | 2-A2 | 1-A1 | FO |
| K | GO | 1-A2 | 2-A2 | FO |

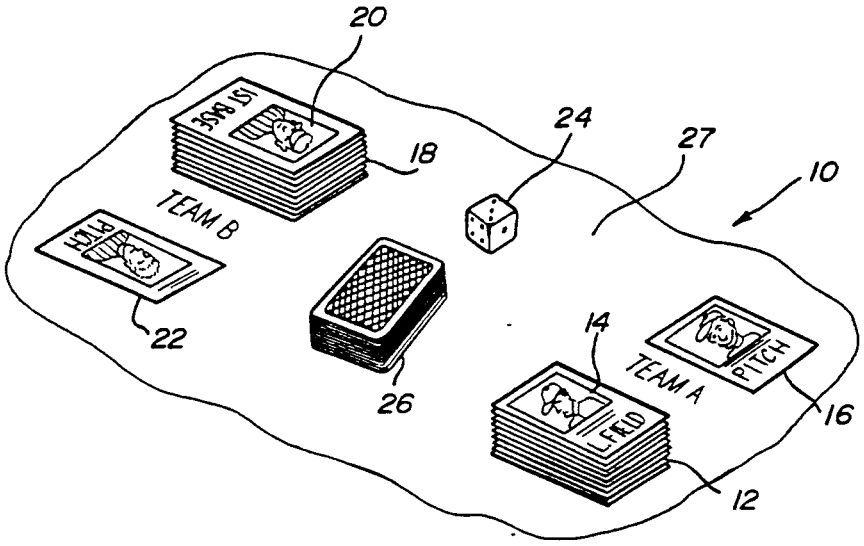

Fig-1

30

| Jones, John<br>1st Base<br>New York Yankees | | | | |
|---|---|---|---|---|
| | Heart | Club | Diamond | Spade |
| A | GO | GO | FO A1 | HR |
| 2 | FO | GO | GO | GO |
| 3 | GO | Walk | 1-A2 | GO-DP |
| 4 | GO | HR | FO | FO |
| 5 | Walk | 1-A1 | SO | FOA-1 |
| 6 | FO | GO | Walk | SO |
| 7 | FO | FO-A1 | FO-A1 | 1-A2 |
| 8 | FO | GO | GO | GO |
| 9 | 1-A2 | 1-A2 | GO | FO-A1 |
| 10 | 1-A2 | 1-A2 | FO | 1-A1 |
| J | FO | 1-A1 | GO | GO |
| Q | FO | 2-A2 | 1-A1 | FO |
| K | GO | 1-A2 | 2-A2 | FO |

Fig-2

28

| Smith, Mike<br>Pitcher<br>Detroit Tigers | | | | |
|---|---|---|---|---|
| | Heart | Club | Diamond | Spade |
| A | SO | GO | 1-A2 | HR |
| 2 | 1-A1 | SO | FO | GO |
| 3 | HR | HR | SO | 2-A2 |
| 4 | Walk | Walk | 1-A1 | GO |
| 5 | GO | FO | FO | Walk |
| 6 | SO | 2-A2 | FO | SO |
| 7 | 1-A1 | 1-A2 | 2-A2 | Walk |
| 8 | GO | GO | FO | FO |
| 9 | FO | HR | HR | FO |
| 10 | 1-A2 | 1-A2 | SO | Walk |
| J | SO | 2-A2 | SO | FO |
| Q | FO | GO | GO | HR |
| K | Walk | Walk | 1-A1 | FO |

Fig-3

BASEBALL GAME

BACKGROUND OF THE INVENTION

I. Field of the Invention

This invention relates to a Baseball Game and more specifically to a type of baseball game that can be played by one or more persons with baseball trading cards showing the picture of a baseball player on one side and a "Baseball Game" matrix on the reverse side.

II. Description of the Prior Art

Many games have been developed to play a simulated game of baseball. One example is U.S. Pat. No. 4,653,755 to Panella et al. The Panella et al game uses a game board with a ball diamond imprinted thereon. Each game player picks a set of baseball picture player cards to represent batters in the play of the game. This game uses pegged pieces to represent the location of team players at various base positions around the playing diamond.

SUMMARY OF THE INVENTION

The purpose of the present invention is to provide a baseball game to be played, usually by two persons, using special baseball player cards in a quick convenient yet realistic manner.

Play is begun as a batter card and a pitcher card are selected from each team. A card is then drawn from a standard deck of cards; a die is tossed. If the die shows an even number, the matrix on the back of the batter's card is used. If an odd number shows, the matrix on the back of the pitcher's card is used as follows.

The card drawn from the standard deck of cards is used to determine a play from its suit and value. For example, a ten of hearts would direct the game players to that cell of the matrix on the appropriate player's card. The matrix cells contain standard plays and are intended to be representative of statistics for the individual player shown on the front of the card. The pitcher's cards contain defensive statistics in the matrix.

This game is easily played in most settings. The requirements are simple as only a die, a standard deck of cards and the baseball player cards are needed. A note pad might additionally be employed to keep the boxed score. A game board could be used but is not essential to the playing of the game.

It is envisioned that these baseball player's cards could be distributed through the standard channels such as in bubble gum packages. Alternatively, an entire historic team's cards could be produced and sold as a unit. With such, for example, the great New York Yankees team of Babe Ruth's era could play a current team to determine a "century" world series winner.

BRIEF DESCRIPTION OF THE DRAWINGS

FIG. 1 is a perspective view of the cards arranged to play the game;

FIG. 2 shows the matrix on the back of a player's card;

FIG. 3 shows a matrix as used on the back of a pitcher's card and

DETAILED DESCRIPTION OF THE INVENTION AND PREFERRED EMBODIMENT THEREOF

Rules and Play of the Game

Figure 4:
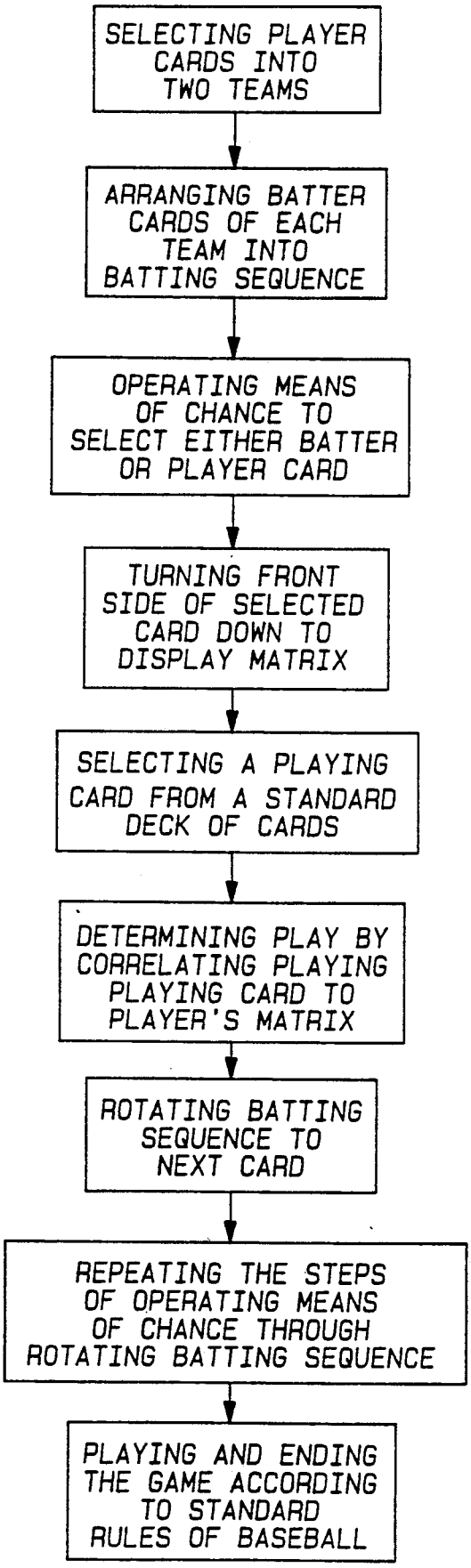
FIG. 4 is a flow chart showing how the game is played.

The game apparatus is generally indicated as 10 in FIG. 1. A game board 27 can be used on which to play the game.

The people playing the game of the instant invention will be called Team Coach A and Team Coach B to facilitate explanation. Two teams, Team A and Team B, are selected by the respective coaches. There are nine player's cards on each team and one pitcher's card for each team. A standard deck of playing cards having suits of clubs, hearts, diamonds and spades with each suit having face cards of a Jack, King, Queen, and Ace and numerical value cards of 2 through 10 and one die are utilized.

To play this game of baseball, after the Team A and Team B players are selected, the Team A cards are arranged by Team Coach A in batting order in a Team A stack 12 as indicated in FIG. 1. The first batter's card 14 is at the top of the stack 12. The pitcher's card 16 for Team A is placed adjacent the Team A stack 12.

The opposing team cards, Team B, are arranged by Team Coach B in a stack 18 opposite the Team A stack. This Team B stack 18 contains all the players in their batting order. The top card 20 in the stack is the first batter. The Team B pitcher's card 22 is placed adjacent the Team B stack 18.

A die 24 and a standard deck of playing cards 26 are then used to simulate a play.

FIG. 2 shows a matrix 30 having various play configurations correlated to the suits and sequential values of a deck of standard playing cards 26.

This matrix 30 is located on the back side of a player's card, in this case, the Team B batter card 20. The matrix 30 has play configurations on the back side of the card which represent the statistics of the player shown on the front side of the card. If the player is known to be a frequent home run hitter, then more home run plays would be contained in the matrix 30.

FIG. 3 shows a pitcher's matrix 28 which is on the back side of a pitcher's card. In this case, the matrix 28 is on the back side of pitcher's playing card 16 for Team A.

FIG. 4 is a flow chart showing the steps for playing the game.

In order to play a game each Team Coach selects his roster of player's cards and aligns them in batting order and selects his pitcher.

The game is played as indicated in the rules outlined below and the regular rules of baseball. Standard baseball nomenclature applies. Some of the abbreviations used are as follows: GO=Ground Out; OF-AL=(Batter) Fly Out-All runners advance one base; HR=Home Run; and etc.

1. To start, the first batter comes up against the opposing team's pitcher.
2. The back side of the individual player's baseball card is turned up displaying the matrix.
3. The standard deck of cards 26 is shuffled and a card is selected from it.
4. The die is tossed and depending on whether it is odd or even determines which matrix is to be used. For example, if an odd number comes up the pitcher's matrix is used.

5. If an ace of spades is the card selected from the standard deck of playing cards, then the matrix cell for an ace of spades on the back side of the pitcher's card is checked for the play to be used. A home run is indicated by the corresponding matrix cell, so the team batting makes one run.
6. That batter's card is then placed at the bottom of the stack so as to maintain the batting order.
7. The next batter then faces off against the pitcher and the die is thrown determining which matrix will be used.
8. A card is then selected from the standard playing deck to create the play as indicated by the cell determined by the playing card's suit and value. The game is played in this manner until there are three outs for each team per inning and until nine innings are played which constitutes a full game of baseball.
9. A Team Coach for this game functions as a team coach does in the real world of baseball. The Team Coach can pull players out of the line-up, can retire a batter and bring in a fresh one just as his real counterpart can.

This game is a very simple, quick and fun game to arrange and play. The baseball player cards can be purchased in team sets or individual sets and it is intended that they can be traded. In this manner, the team coach can select the players he wants for his team. An individual playing this game can coach both teams if desired.

Although only the preferred embodiment of the game has been described, it is to be understood that all variations and modifications in the embodiment are encompassed thereby and are to be regarded as being within the spirit of the invention as defined by the scope of the appended claims.

I claim:

1. A baseball game comprising:
a plurality of baseball player cards representing batters and pitchers;
a deck of standard playing cards having suits and numerically sequential values;
a means of chance for selecting either a batter card or pitcher card from said plurality of baseball playing cards for use in determining a play;
each of said baseball player cards having a front side bearing the indicia of an individual baseball player and a back side having a matrix of play information correlated to said suits and sequential values of said standard deck of cards; and
wherein one of said standard playing cards having a suit and a value is exposed and said next play is determined from said suit and said value of one of said standard playing cards in accordance with said matrix of play information of said selected batter card or pitcher card.

2. The baseball game as defined in claim 1 wherein said means of chance is a die.

3. The baseball game as defined in claim 1 wherein said matrix of play information represents playing statistics of said individual baseball player shown on the front side of the card.

4. The baseball game as defined in claim 1 wherein said plurality of baseball player cards are separable into opposing teams for the game.

5. The baseball game as defined in claim 1 wherein said baseball player cards are arranged in a team grouping.

6. The baseball game as defined in claim 1 further comprising a game board.

7. A method for playing a game having baseball player cards representing batters and pitchers and a deck of standard playing cards having suits and numerically sequential values, each of said baseball player cards having a front side bearing indicia of an individual player and a back side having a matrix of play information correlated to the suits and sequential values of said standard deck of cards and having a means of chance for selecting one of said batter cards or pitcher cards for use in play comprising the steps of:
selecting player cards to form two teams, each team having nine batters and a pitcher;
arranging said batter player cards for each team in a batting sequence;
operating said means of chance for selecting either said pitcher card or said batter card from said batting sequence;
turning said front side of said selected card down to expose said matrix of play information;
selecting a playing card from said deck of standard playing cards to determine a suit and a value;
determining a first play from said matrix of play information of said baseball player card in accordance with said suit and said value of said selected playing card;
rotating said batting sequence to select another of said batter player cards in said sequence for another play;
repeating said steps of operating said means of chance through said step of rotating said batting sequence; and
playing and ending the game in accordance with standard rules of baseball.

* * * * *